US010472940B2

(12) United States Patent
Wells et al.

(10) Patent No.: US 10,472,940 B2
(45) Date of Patent: Nov. 12, 2019

(54) DIRECT CONNECT SUB FOR A PERFORATING GUN

(71) Applicant: G&H Diversified Manufacturing LP, Houston, TX (US)

(72) Inventors: Joe Noel Wells, Lindale, TX (US); Benjamin Vascal Knight, Katy, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 529 days.

(21) Appl. No.: 15/148,791

(22) Filed: May 6, 2016

(65) Prior Publication Data

US 2016/0333675 A1 Nov. 17, 2016

Related U.S. Application Data

(60) Provisional application No. 62/162,127, filed on May 15, 2015.

(51) Int. Cl.
*E21B 43/119* (2006.01)
*E21B 43/116* (2006.01)

(52) U.S. Cl.
CPC ..... *E21B 43/119* (2013.01); *E21B 43/116* (2013.01)

(58) Field of Classification Search
CPC .... E21B 43/119; E21B 43/116; E21B 43/117; E21B 43/1185
See application file for complete search history.

(56) References Cited

U.S. PATENT DOCUMENTS 2,946,926 A * 7/1960 Hawthorne ..... E21B 43/1185 324/221
3,010,396 A * 11/1961 Coleman ..... E21B 43/1185 175/4.55
3,071,072 A * 1/1963 Castel ..... E21B 43/118 175/4.53
4,266,613 A * 5/1981 Boop ..... F42D 1/04 166/299
5,052,489 A * 10/1991 Carisella ..... E21B 43/1185 166/297
5,571,986 A * 11/1996 Snider ..... E21B 43/1185 102/275.11
5,911,277 A * 6/1999 Hromas ..... E21B 43/11852 166/297
6,918,334 B2 * 7/2005 Trotechaud ..... E21B 43/1185 102/202.12
7,878,242 B2 * 2/2011 Gray ..... E21B 23/00 166/250.13
8,079,296 B2 * 12/2011 Barton ..... E21B 43/1185 175/4.56
2005/0016769 A1 * 1/2005 Wallace ..... H01R 13/523 175/40

* cited by examiner

*Primary Examiner* — Michael R Wills, III
(74) *Attorney, Agent, or Firm* — Conley Rose, P.C.

(57) ABSTRACT

A perforating gun assembly includes a perforating gun body, a casing collar locator, and a direct connect sub coupled to the CCL and the perforating gun body. In an embodiment, the direct connect sub includes a single body including a central axis, a first end, and a second end. The first end is engaged with the CCL, and the second end is engaged with the perforating gun body.

16 Claims, 9 Drawing Sheets

DIRECT CONNECT SUB FOR A PERFORATING GUN

CROSS-REFERENCE TO RELATED APPLICATIONS

This application claims benefit of U.S. provisional patent application Ser. No. 62/162,127 filed May 15, 2015, and entitled "Direct Connect Sub For A Perforating Gun," which is hereby incorporated herein by reference in its entirety.

STATEMENT REGARDING FEDERALLY SPONSORED RESEARCH OR DEVELOPMENT

Not applicable.

BACKGROUND

During completion operations for a subterranean wellbore of an oil or gas well, shaped explosive charges conveyed in one or more perforating guns are used to perforate the well casing or casings to create a flow path for gas and or fluids to flow between the subterranean formation and the wellbore. The perforating guns are typically attached to a tool string, a casing collar locator, and to each other by plurality of threaded connecting subs, quick change adapters, and/or other devices.

BRIEF SUMMARY OF THE DISCLOSURE

Some embodiments are directed to a perforating gun assembly. In an embodiment, the perforating gun assembly includes a perforating gun body, a casing collar locator (CCL), and a direct connect sub coupled to the CCL and the perforating gun body. The direct connect sub includes a single body including a central axis, a first end, and a second end. The first end is engaged with the CCL, and the second end is engaged with the perforating gun body.

Other embodiments are directed to a direct connect sub for coupling a casing collar locator (CCL) to a perforating gun body. In an embodiment, the direct connect sub includes a single body including a central axis, a first end, and a second end. In addition, the direct connect sub includes a first set of threads disposed proximate the first end that are configured to threadably engage with the CCL. Further, the direct connect sub includes a second set of threads disposed proximate the second end that are configured to threadably engage with the perforating gun body.

Still other embodiments are directed to a direct connect sub for coupling a perforating gun body to a component. In an embodiment, the direct connect sub includes a single body including a first end and a second end, a first set of threads disposed proximate the first end that are configured to threadably engage with the component, and a second set of threads disposed proximate the second end that are configured to threadably engage with the perforating gun body. In addition, the direct connect sub includes an electrical contact assembly disposed within the body of the direct connect sub. The electrical contact assembly includes a housing including an internal bore, wherein the housing is disposed within and sealingly engages a first axial passage within body. In addition, the electrical contact assembly includes a contact pin that is partially disposed within the bore and configured to translate within the bore, a plug disposed within and sealingly engaging the bore of the housing, and a biasing member disposed within the bore of the housing. The biasing member extends between the contact pin and the plug and electrically couples the contact pin to the plug. Further, the electrical contact assembly includes a conductor electrically coupled to the plug. The conductor extends into a second axial passage within the body that extends axially from the first axial passage. Further, the direct connect sub includes a port extending radially from an outer surface of the housing to the second axial passage.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION OF EXEMPLARY EMBODIMENTS

Figure 1:
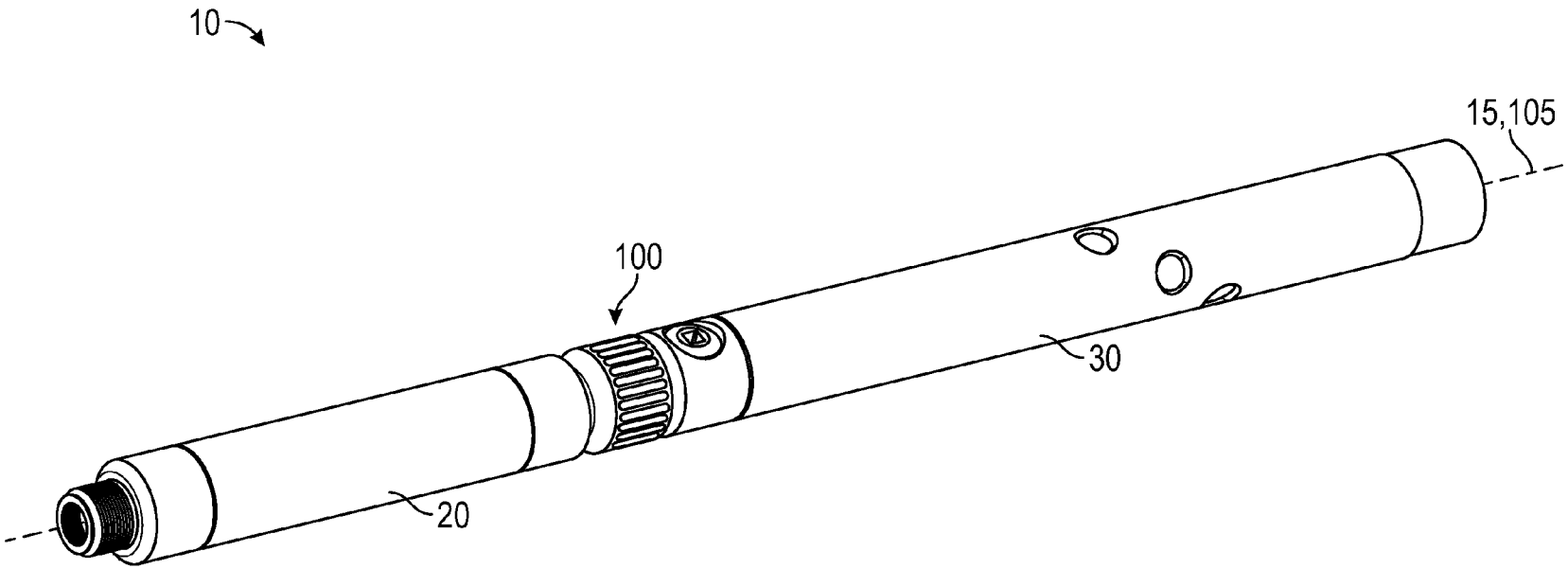
FIG. 1 is a perspective view of a perforating gun assembly in accordance with at least some embodiments disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring again to FIGS. 1 and 2, a perforating gun assembly 10 for perforating a subterranean well is shown. In this embodiment, perforating gun assembly 10 includes a central or longitudinal axis 15, a perforating gun 30, a casing collar locator (CCL) 20, and a direct connect sub 100 directly connected to and extending axially between perforating gun 30 and CCL 20.

Perforating gun body 30 includes a plurality of explosive charges (not shown) that are configured to perforate the downhole casing pipe(s) when activated or initiated. CCL 20 includes one or more magnetic sensors (not shown) that are configured to sense or record a change in magnetic flux that occurs when the CCL 20 passes by a casing collar or similar connector devices connecting two axially adjacent casing pipes to one another. The sensed or recorded change in magnetic flux may then be correlated to the depth of the CCL 20 and thus also the perforating gun assembly 10 such that an operator may determine or confirm that perforating gun assembly 10 is at a desired depth. CCL 20 may be any known CCL, including, for example, the embodiments disclosed in U.S. patent application Ser. No. 14/921,686, the entire contents of which are incorporated herein by reference in their entirety for all purposes.

Figure 2:
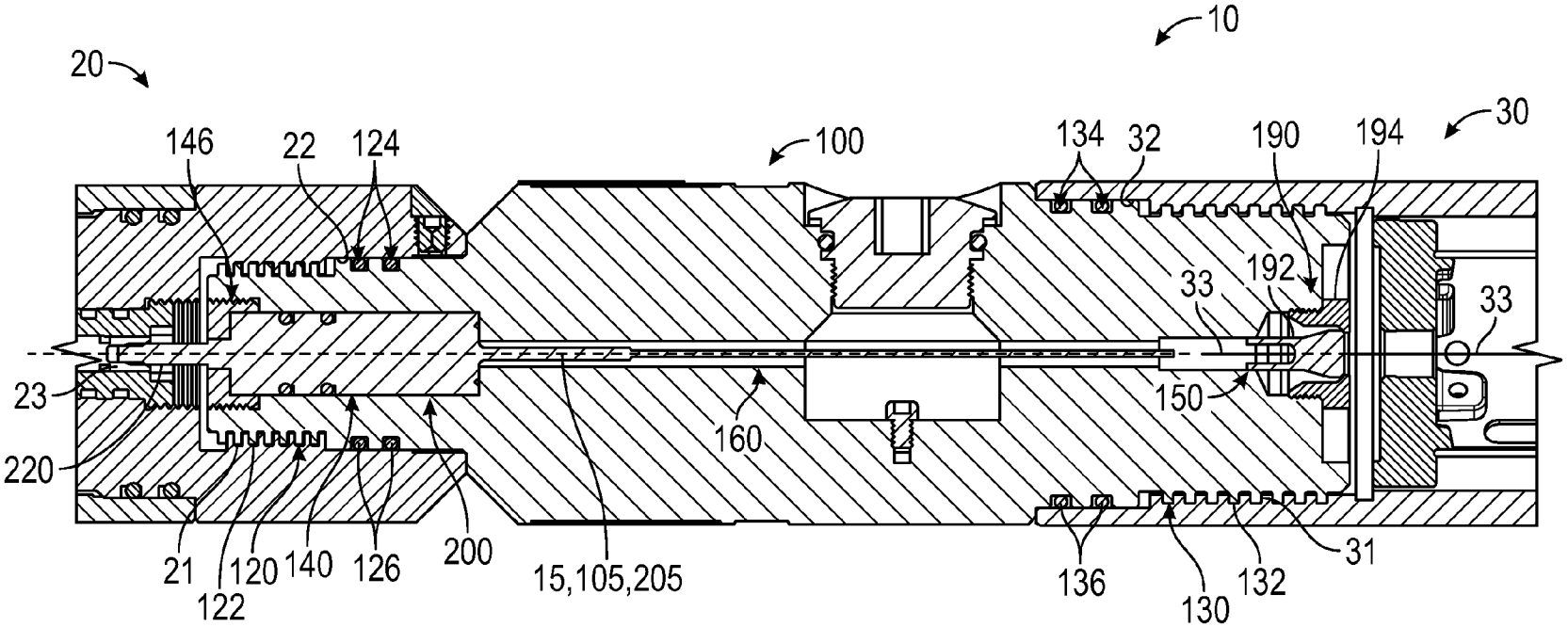
FIG. 2 are side, cross-sectional view of a portion of the perforating gun assembly of FIG. 1.
Figure 3:
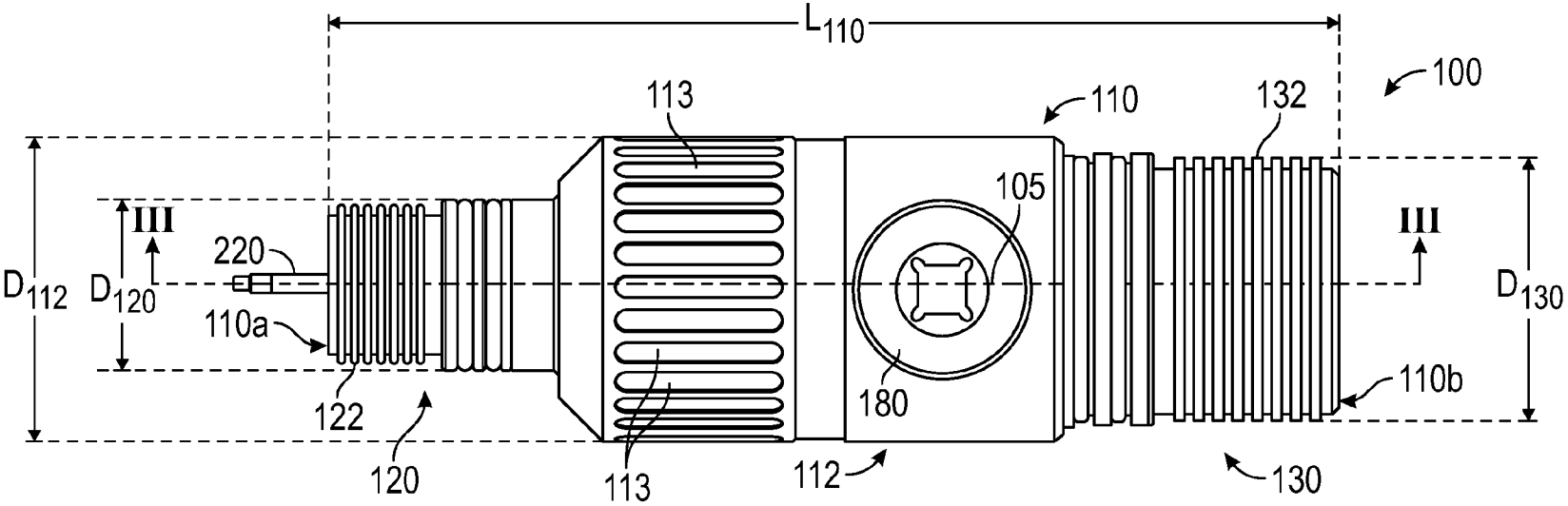
FIG. 3 is a side view of a direct connect sub of the perforating gun assembly of FIG. 1.
Figure 4:
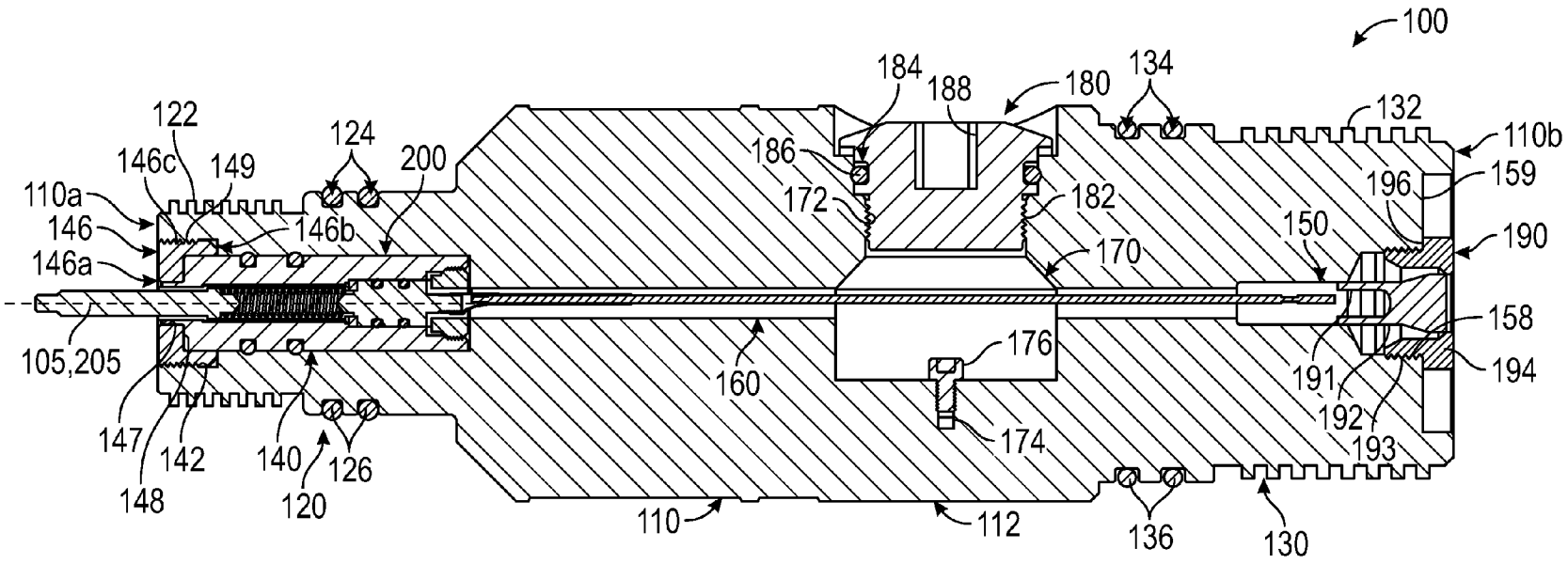
FIG. 4 is a cross-section view of the direct connect sub of FIG. 3 taken along section in FIG. 3.

Referring now to FIGS. 3 and 4, direct connect sub 100 (or more simply "sub 100") includes a generally cylindrical singular body 110 and an electrical contact assembly 200 disposed within body 110 (see FIG. 4). Body 110 includes a central or longitudinal axis 105 that is aligned with axis 15 of perforating gun assembly 10 during operations (see FIGS. 1 and 2). In addition, body 110 includes a first or upper end 110*a*, a second or lower end 110*b* opposite upper end 110*a*, a first or upper connector 120 extending axially from upper end 110*a*, a second or lower connector 130 extending axially from lower end 110*b*, and a central body portion 112 extending axially between upper connector 120 and lower connector 130.

Upper connector 120 includes a set of external threads 122 and a maximum outer diameter $D_{120}$, and lower connector 130 includes a set of external threads 132 and a maximum outer diameter $D_{130}$. Central body portion 112 includes a maximum outer diameter $D_{112}$ and a plurality of radially extending recesses 113 that are configured to provide an engagement surface for a tool (e.g., wrench) during coupling of sub 100 to CCL 20 and perforating gun 30. In this embodiment, maximum outer diameter $D_{112}$ of central body portion 112 is larger than maximum outer diameters $D_{130}$, $D_{120}$ of connectors 130, 120, respectively, and maximum outer diameter $D_{130}$ of lower connector 130 is larger than maximum outer diameter $D_{120}$ of upper connector 120. In some embodiments, maximum outer diameter $D_{112}$ may range from 1⅜ in to 7 in, maximum outer diameter $D_{120}$ may range from 1 in to 3 in, and maximum outer diameter $D_{130}$ may range from 1 in to 6¾ in; however, other diameters are possible. Further, body 110 has an axial length $L_{110}$ extending along axis 105 between ends 110*a*, 110*b*. In some embodiments, axial length $L_{110}$ may range from 2 in to 10 in; however, other lengths are possible.

A first pair of annular seal grooves 124 are disposed axially adjacent one another along upper connector 120, and a second pair of annular seal grooves 134 are disposed axially adjacent one another along lower connector 130. Each annular seal groove 124 on upper connector is configured to receive an annular sealing member 126 (e.g., an O-ring) therein, and each annular seal groove 134 is configured to receive an annular sealing member 136 (e.g., an O-ring) therein.

Referring again to FIG. 2, during operations upper connector 120 is threadably engaged with CCL 20 via engagement between external threads 122 on connector 120 and internal threads 21 within CCL 20 such that annular sealing members 126 are radially compressed between seal grooves 124 and a mating surface 22 within CCL 20. As a result, sealing members 126 form a static seal that prevents fluid flow between connector 120 and CCL 20 (particularly mating surface 22 within CCL 20) during operations. In addition, during operations, lower connector 130 is threadably engaged with perforating gun body 30 via engagement between external threads 132 on connector 130 and internal threads 31 within perforating gun body 30 such that annular sealing members 136 are radially compressed between seal grooves 134 and a mating surface 32 within perforating gun body 30. As a result, sealing members 136 form a static seal that prevents fluid flow between lower connector 130 and perforating gun body 30 (particularly mating surface 32 within perforating gun body 30). In some embodiments sealing members 126, 136 comprise an elastomer such as, for example, nitrile and/or VITON®.

Referring now to FIG. 4, body 110 of sub 100 also includes a first axial passage 140 extending axially from upper end 110*a*, a second axial passage 150 extending axially from lower end 110*b*, and a third axial passage 160 extending axially from first axial passage 140 to second axial passage 150. First axial passage 140 includes a set of internal threads 142. Second axial passage 150 includes a radially extending annular shoulder 159 and a set of internal threads 158 axially adjacent annular shoulder 159. In this embodiment annular shoulder 159 is axially disposed between internal threads 159 and lower end 110*b* of body 110. Further, a radially extending passage or port 170 extends radially into central body portion 112 that includes a set of internal threads 172. A threaded hole 174 extends within port 170 for grounding purposes. Specifically, during operations, another component may be electrically grounded to body 110 by coupling a conductive wire or other components to a coupling member 176 threadably inserted within hole 174. It should be appreciated that the exact positioning of hole 174 may be altered in other embodiments. In still other embodiments, no such grounding hole 174 is included.

Body 110 may comprise any suitable rigid material suitable for use within a subterranean wellbore. For example, body 110 may comprise steel alloy such as, for example, 4340 alloy steel. However, other materials are possible, such as, for example, stainless steel, a composite, etc. In addition, in some embodiments a surface finish may be applied to body 110 (e.g., outer surfaces of body 110) to provide corrosion resistance and maximize component life; however, such surface finishes are not required. In this embodiment, body 110 is a single monolithic body or piece.

Referring again to FIGS. 3 and 4, a port plug 180 is removably installed within radially extending port 170 of body 110 during operations. Port plug 180 includes a set of external threads 182, and an annular seal groove 184 that receives an annular sealing member 186 (e.g., an O-ring, flat gaskets, etc.) therein. Port plug 180 is secured within radially extending bore 170 by threadably engaging external threads 182 on port plug 180 with the internal threads 172 within port 170. In addition, when port plug 180 is secured within bore 170, sealing member 186 within annular seal groove 184 is compressed between groove 184 and a corresponding surface of port 170 such that a static seal is formed between port plug 180 and port 170 that prevents fluid flow between port 170 and port plug 180 during operations. In addition, port plug 180 also includes an engagement bore 188 extending from an outer end to facilitate installation and removal of port plug 180 within port 170 (e.g., with a wrench or similar tool configured to engage within bore 188). During operations, port plug 180 is threadably removed from port 170 to provide access to third axial passage 160 within body 110 (e.g., to couple electrical conductors from both electrical contact assembly 200 and perforating gun body 30 as explained below).

In some embodiments, port plug 180 may comprise a steel alloy, such as, for example, 4340 alloy steel; however, other materials are possible. In addition, the annular seal 186 may comprise any suitable sealing material capable of withstanding wellbore conditions. In some embodiments, sealing member 186 may comprise nitrile, and/or VITON®. In some embodiments, a surface finish may be applied to port plug 180 to provide corrosion resistance and maximize component life; however, such surface finishes are not required.

Referring particularly now to FIG. 4, a dart assembly 190 is installed within second axial passage 150. Dart assembly 190 includes a dart 192 and a dart retainer 194. Dart 192 includes a cutting surface 191 and is disposed within retainer 194. Dart retainer 194 includes a set of external threads 193 and an external radially extending annular shoulder 196. Dart assembly 190 is secured within second axial passage 150 by inserting dart 192 within second axial passage 150 and then threadably engaging the external threads 193 on dart retainer 194 within internal threads 158 until annular shoulder 196 on retainer 194 engages or abuts with annular shoulder 159 in second axial passage 150.

Referring now to FIGS. 1-4, electrical contact assembly 200 is disposed within body 110 and electrically couples an electrical contact 23 within the CCL 20 and another electrical contact or conductor 33 extending from perforating gun body 30 into body 110. In addition, in at least some embodiments, contact assembly 200 provides a bulkhead seal for the internal passages of the CCL 20 both from the blast of the perforating gun body 30 and the wellbore conditions (e.g., after the perforating gun body 30 has been fired).

Figure 5:
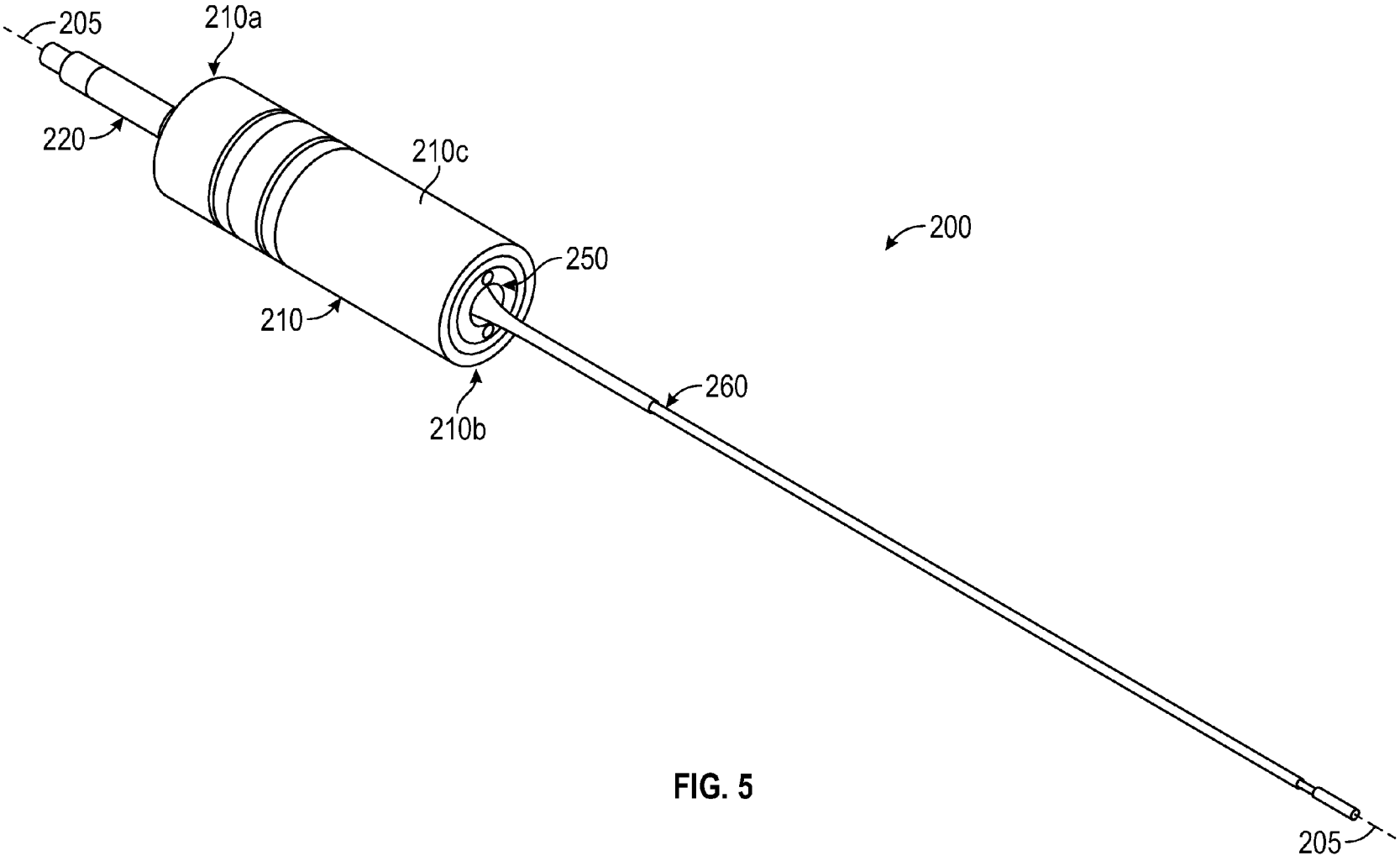
FIG. 5 is a perspective view of an electrical contact assembly for use within the direct connect sub of FIG. 3.
Figure 6:
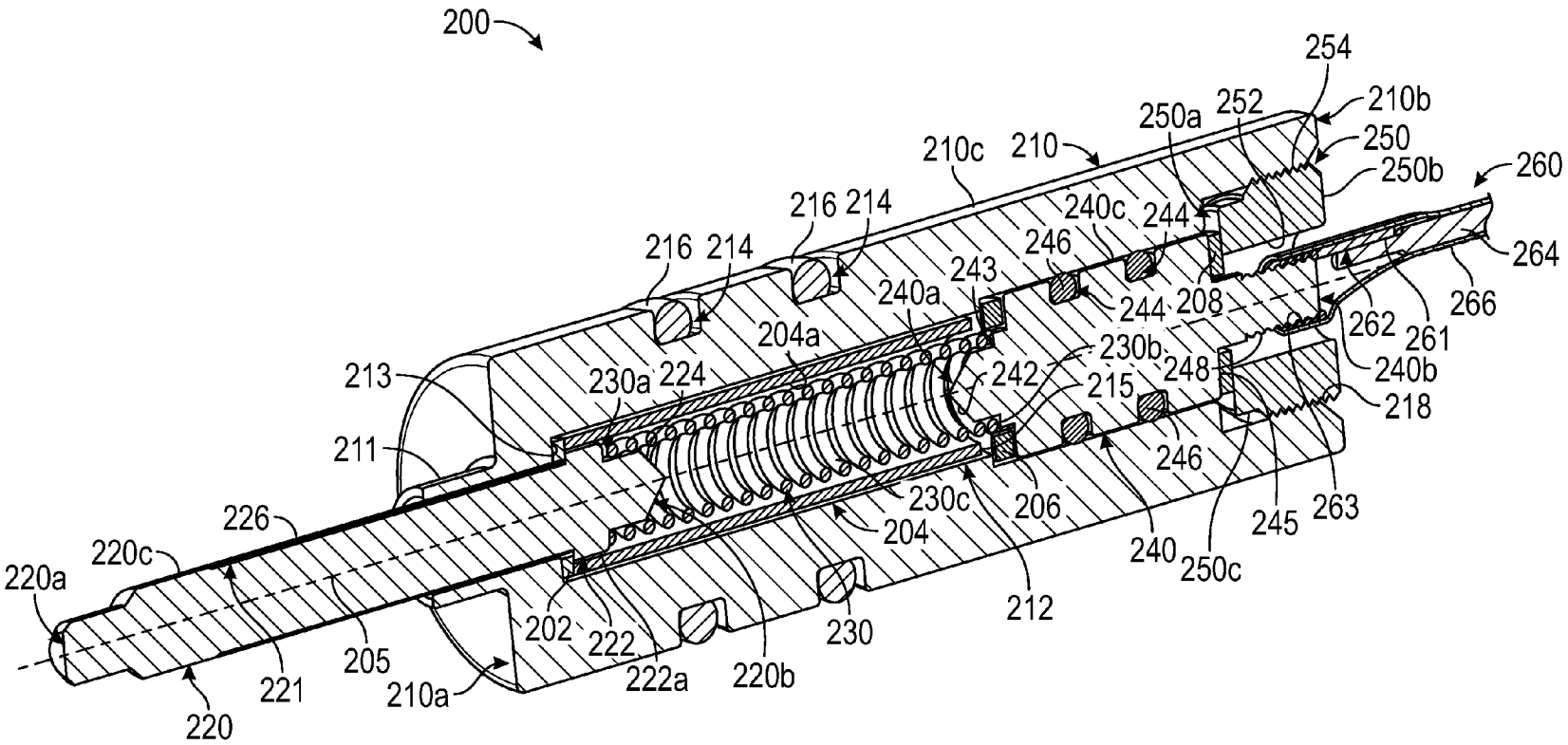
FIG. 6 is a perspective cross-sectional view of the electrical contact assembly of FIG. 5.
Figure 7:
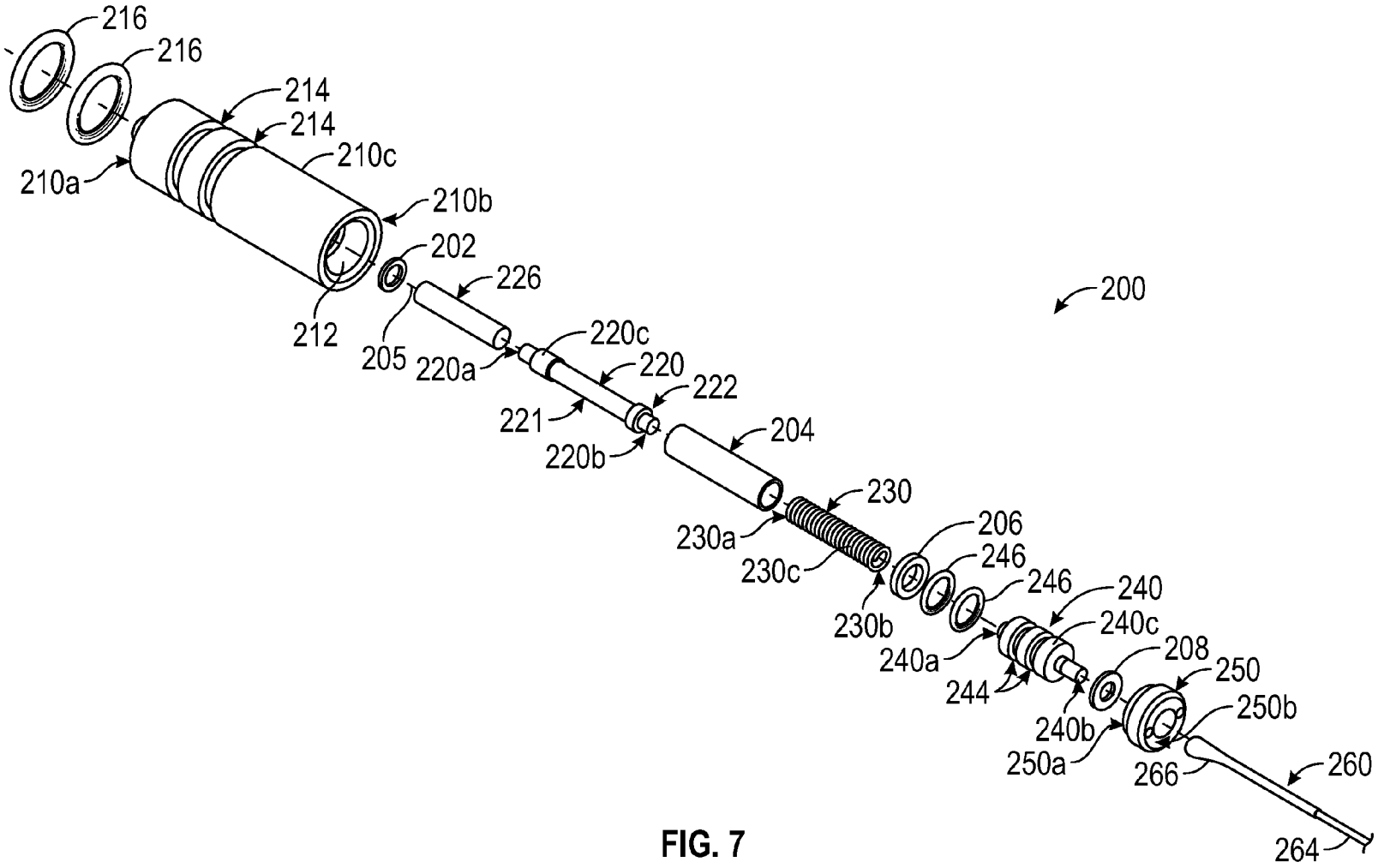
FIG. 7 is an exploded view of the electrical contact assembly of FIG. 5.

Referring now to FIGS. 5-7, contact assembly 200 generally includes a central or longitudinal axis 205 that is aligned with axis 105 during operations. In addition, contact assembly 200 includes a housing 210, a contact pin 220, a biasing member 230, a plug 240, a retainer 250, and a pig tail assembly 260.

Housing 210 includes a first or upper end 210*a*, a second or lower end 210*b* opposite upper end 210*a*, and a radially outermost cylindrical surface 210*c* extending axially between ends 210*a*, 210*b*. In addition, housing 210 includes an internal passage or bore 212 extending axially between ends 210*a*, 210*b*. A cylindrical collar 211 extends axially from upper end 210*a* and is aligned with bore 212. In addition, bore 212 includes a first or upper annular shoulder 213 extending radially with respect to axis 205 and disposed axially between ends 210*a*, 210*b*. Further, bore 212 includes a second or lower annular shoulder 215 extending radially with respect to axis 205 and disposed axially between upper annular shoulder 213 and lower end 210*b*. Still further, bore 212 includes a set of internal threads 218 disposed proximate (or at) lower end 210*b*. Radially outer surface 210*c* includes a pair of axially spaced annular seal grooves 214 each housing a corresponding sealing member 216 (e.g., an O-ring) which may be similar to sealing members 126, 136, previously described. In some embodiments, housing 210 comprises an aluminum material such a, for example 6061, 2011; however, other materials are possible.

Referring still to FIGS. 5-7, contact pin 220 includes a first or upper end 220*a*, a second or lower end 220*b* opposite upper end 220*a*, and a radially outermost surface 220*c* extending axially between ends 220*a*, 220*b*. Lower end 220*b* includes a conical tip 224. In addition radially outermost surface 220*c* is generally cylindrical in shape and includes a flange 222 disposed axially proximate to lower end 220*b*, and an annular recess 221 extending axially from flange 224 toward upper end 220*a*. Annular recess 221 is a region, portion, or section of radially outermost surface 220*c* that is radially recessed inward relative to immediately axially adjacent regions, portions, or section of outermost surface 220*c*. As a result, contact pin 220 includes a smaller outer diameter at annular recess 221 then portions of radially outermost surface 220*c* that are immediately axially adjacent to annular recess 221. In this embodiment an insulating sleeve 226 is disposable about contact pin 220 at annular recess 221. Insulating sleeve 226 comprises a thin wall tube that electrically insulates contact pin 220 from the housing 210. In some embodiments, insulating sleeve 226 may comprise any suitable heat shrink tubing material that is resistant to abrasion. For example, in some embodiments, insulating sleeve 226 comprises polyether ether ketone (PEEK). In addition, in some embodiments, contact pin 220 may comprise any conductive material, such as, for example mild steel, aluminum, brass, etc. Further, in some embodiments, a surface finish may be applied to contact pin 220 depending on the material used.

Biasing member 230 may comprise any suitable biasing member for biasing two members apart from one another along a longitudinal axis. In this embodiment, biasing member 230 comprises a coiled spring and thus includes a first or upper end 230*a*, a second or lower end 230*b* opposite upper end 230*a*, and a body 230*c* extending helically between ends 230*a*, 230*b*. Biasing member 230 may comprise any suitable electrically conductive material, such as, for example, music wire, stainless steel, a conductive polymer, etc. In addition, in some embodiments, biasing member 230 may include a surface finish, dependent on material used. It should be appreciated that in other embodiments, biasing member 230 may comprise other suitable biasing devices or members, such as, for example, a leaf spring, one or more Belleville washers, etc.

Referring still to FIGS. 5-7, plug 240 includes a first or upper end 240*a*, a second or lower end 240*b* opposite upper end 240*a*, and a radially outermost surface 240*c* extending between ends 240*a*, 240*b*. Upper end 240*a* includes a conical tip 242. Radially outermost surface 240*c* includes a first or upper annular shoulder 243 extending radially with respect to axis 205 and disposed axially between ends 240*a*, 240*b*. In addition, radially outermost surface 240*c* includes a second of lower annular shoulder 245 extending radially with respect to axis 205 and axially disposed between upper annular shoulder 243 and lower end 240*b*. Further, radially outermost surface 240*c* includes a set of external threads 248 extending from lower end 240*b*. Radially outermost surface 340*c* also includes a pair of axially spaced annular seal grooves 244 each housing a corresponding sealing member 246 (e.g., an O-ring) which may be similar to sealing members 126, 136, previously described. In some embodiments, plug 240 comprises an aluminum material, such as, for example, 6061, 6262, etc. In addition, in some embodiments, plug 240 includes a hard anodized surface finish to all surfaces except conical tip 242, upper annular shoulder 243, and external threads 248. Without being limited to this or any other theory, hard anodizing the outer surfaces of plug 240 electrically insulates the anodized surfaces during operations. Thus, in at least some embodiments, only those surfaces (e.g., portions of radially outermost surface 240*c*) that are expected to contact bore 212 of housing are anodized.

Retainer 250 is an annular member including a first or upper end 250*a*, a second or lower end 250*b* opposite upper end 250*a*, an internal bore 252 extending axially between ends 250*a*, 250*b*, and a radially outermost surface 250*c* also extending axially between ends 250*a*, 250*b*. Radially outer surface 250*c* includes a set of external threads 254 disposed proximate (or at) lower end 250*b*.

As best shown in FIG. 6, pig tail assembly 260 includes an electrical terminal, 262, an electrical conductor 264, and an outer covering 266. Electrical terminal 262 includes a set of internal threads 263 and an electrical contact 261. Each of the threads 263 and contact 261 may comprise any suitable electrically conductive material (e.g., a metal). Electrical conductor 264 is engaged with electrical contact 261 and comprises any suitable electrically conductive material (e.g., a metal). In some embodiments, electrical conductor 264 includes insulation or an insulating sleeve (except for the portion in contact with electrical contact 261). In this embodiment, electrical conductor 264 comprises a conductive wire. Outer covering 266 is an electrically insulating material that is formed about electrical terminal 262 and at least a portion of conductor 264 (e.g., at least the portion of conductor 264 in contact with electrical contact 261). In some embodiments, outer covering 266 is a heat shrink tubing that is form fit about electrical terminal 262 and at least a portion of conductor 264.

Referring again to FIGS. 5-7, to assemble electrical contact assembly 200, an electrically insulating washer 202 is inserted axially within bore 212 from lower end 210*b* until washer 202 engages or abuts upper annular shoulder 213. Next, an electrically insulating tube 204 is axially inserted within bore 212 from lower end 210*b*. Contact pin 220 is then axially inserted through bore 212 of housing 210 from lower end 210*b* and through insulating tube 204 until flange 222 engages or abuts with washer 202. As shown in FIG. 6, contact pin 220 is inserted within bore 212 and insulating tube 204, flange 222 is disposed within insulating tube 204 such that a radially outermost surface 222*a* of flange 222 sliding engages and radially innermost surface 204*a* of insulating tube 204 during operations. Next, biasing member 230 is axially inserted within bore 212 from lower end 210*b* until upper end 230*a* engages or abuts flange 222 and body 230*c* is at least partially received within insulating tube 204. Another insulating washer 206 is then axially inserted within bore 212 from lower end 210*b* until washer 206 engages or abuts with lower annular shoulder 215. Thereafter, plug 240 is inserted axially within bore 212 from lower end 210*b* until upper annular shoulder 243 engages or abuts lower end 230*b* of biasing member 230. In addition, when plug 240 is inserted within bore 212, sealing members 246 within seal grooves 244 are each radially compressed between the inner surface of bore 212 and the corresponding groove 244 such that a static seal is formed between plug 240 and bore 212 that prevents the flow of fluid therebetween during operations. Once plug 240 is inserted within bore 212 as described, a third electrically insulating washer 208 is inserted within bore 212 from lower end 210*b* until washer 208 engages or abuts with lower annular shoulder 245 on plug 240. Retainer 250 may then be secured within bore 212 by engaging external threads 254 on retainer 250 with internal threads 218 within bore 212. Retainer 250 may be advanced axially within bore 212 (e.g., via engaged threads 218, 254) until upper end 250*a* engages or abuts insulating washer 208. Thus, securing retainer 250 within bore 212 via threads 218, 254 axially compresses washers 208, 206 and plug 240 against lower annular shoulder 215 within bore 212. Finally, pig tail assembly 260 is coupled to lower end 240*b* of plug 240 through bore 252 in retainer 250. Specifically, threads 263 on electrical terminal are threadably engaged with the external threads 248 on plug 240.

Washers 202, 206, and insulating tube 204 may comprise any suitable electrically insulating material. For example, in some embodiments, washers 202, 206, 208 and insulating tube 204 may comprise polytetrafluoroethylene (PTFE) and/or PEEK.

Once electrical contact assembly 200 is fully assembled as described above, upper end 220*a* of contact pin 220 is electrically coupled to electrical conductor 264 in pig tail assembly 260. Specifically, contact pin 220 is electrically coupled to biasing member 230 via the engagement between upper end 230*a* of biasing member 230 and flange 222 on contact pin 220. Biasing member 230 is electrically coupled to plug 240 via the engagement between lower end 230*b* of biasing member 230 and upper annular shoulder 243 on plug 240. Finally plug 240 is electrically coupled to electrical conductor 264 in pig tail assembly 260 via the engagement between plug 240 and electrical terminal 262 at the engaged threads 248, 263, and via the engagement between electrical contact 261 and electrical conductor 264 previously described.

In addition, once electrical contact assembly 220 is fully assembled, contact pin 220 may be plunged, translated, or reciprocated axially within bore 212 by axially compressing ends 230*a*, 230*b* of biasing member 230 toward one another, while maintaining electrically coupling or connectivity between contact pin 220 and electrical conductor 264. The reciprocation of contact pin 220 is also facilitated by sliding engagement between flange 222 and insulating tube 204 (e.g., by sliding engagement of surface 222*a* of flange 222 and surface 204*a* of insulating tube 204). Further, each of the contact pin 220, biasing member 230, plug 240, electrical terminal 262, and electrical conductor 264 are electrically insulated from housing 210 and retainer 250. Specifically, contact pin 220 is electrically insulated from housing 210 via insulating sleeve 226 (which may slidingly engage with collar 211 and bore 212 during reciprocation of contact pin 220), washer 202, and insulating tube 204. In addition, biasing member 230 is electrically insulated from housing 210 via insulating tube 204. Further, plug 240 is electrically insulated from housing 210 via the anodized hard surfaces along portions of the radially outermost surface 240*c*, and is electrically insulated from retainer 250 via washer 208. Finally, electrical terminal 262 and conductor 264 are electrically insulated from retainer 250 and potentially housing 210 via outer covering 266.

Referring back now to FIGS. 2 and 4, to assembly direct connect sub 100, the dart retainer 194 is threaded into second axial passage 150 of body 110 via engagement of threads 158, 193 and hand tightened. In addition, port plug 180 is removed from port 170. Thereafter, a conductor wire 33 from perforating gun body 30 is inserted through dart retainer 194, second axial passage 150, third axial passage 160, and out the port 170. Then, the dart retainer 194 is removed from second axial passage 150 and dart 192 is installed therein. While not specifically shown, one having ordinary skill will appreciate that dart 192 includes one or more grooves that are sized to accommodate conductor 33 as it passes through second axial passage 150 and toward third axial passage 160. The one or more grooves extend to the cutting surface 191. The dart 192 is pushed into second axial passage 150 just enough to stick and remain in place. The dart retainer 192 is then reinserted and threaded within second axial passage via threads 158, 193 and tightened to a desired torque. Next lower end 110*b* of body 110 is threaded into the perforating gun body 30 via connector 130 and threads 132, 31 as described above, while pulling any slack in the conductor wire 33 from perforating gun body 30 through the port 170.

Thereafter, contact assembly 200 is inserted within axial passages 140, 160 of body 110 such that housing 210 is seated within first axial passage 140 and conductor 264 of pigtail assembly 260 extends through third axial passage 160 and out of port 170. In some embodiment, contact assembly 200 may be lubricated (e.g., housing 210 may be lubricated) prior to inserting contact assembly 200 within first axial passage 140. Housing 210 is then secured within first axial passage 140 with a contact retainer 146.

Referring to FIG. 4, contact retainer 146 includes a first or upper end 146*a*, a second or lower end 146*b* opposite upper end 146*a*, a radially outermost surface 146*c* extending axially between ends 146*a*, 146*b*, and a bore 147 also extending axially between ends 146*a*, 146*b*. An annular shoulder 148 extends radially within bore 147, and a set of external threads 149 is disposed along radially outermost surface 146*c*. In some embodiments, contact retainer 146 comprises a steel alloy, such as, for example, 4140 alloy steel; however, other materials are possible. In addition, in some embodiments, a surface finish may be applied to contact retainer 146 to provide corrosion resistance and maximize component life; however, such surface finishes are not required.

Referring again to FIGS. 2 and 4, once contact assembly 200 is inserted within axial passages 140, 160 as described above, contact retainer 146 is secured within first axial passage 140 via threadably engaging threads 149, 142 until contact pin 220 extends through bore 147, upper end 210*a* of housing 210 engages with annular shoulder 148, and lower end 210*b* of housing engages with annular shoulder 144. Thus, by securing contact retainer 146 within first axial passage 140 via threads 149, 142 housing 210 of electrical contact assembly 200 is axially compressed between annular shoulder 148 in contact retainer 146 and annular shoulder 144 within first axial passage 140. There is sufficient clearance between bore 147 and contact pin 220 such that contact pin 220 may freely axially reciprocate, plunge, or translate relative to housing 210, contact retainer 146, and body 110 during operations in the manner previously described above.

Once housing 210 is fully seated and secured within first axial passage 140 and electrical conductor 264 of pigtail assembly 260 is inserted through third axial passage 160 and port 170, conductor 264 of pigtail assembly 260 is electrically coupled (e.g., connected, spliced, etc.) to the conductor 33 extending from perforating gun body 30 (e.g., by splicing or connecting the conductors 264, 33 to one another through any suitable or known method). Thereafter, the now coupled conductor 264 from pigtail assembly 260 and conductor 33 from perforating gun body 30 are pushed back through port 170 into third axial passage 160 and the port plug 180 is installed (e.g., threaded) into port 170, such that axial passages 140, 150, 160 are sealed from wellbore conditions (e.g., by the engagement of the sealing members 182 and the inner surface forming port 170).

Finally, once perforating gun body 30 is secured to body 110, contact assembly 200 is secured within first axial passage 140, and conductor 264 is coupled to the conductor 33 of perforating gun body 30, CCL 20 may be threadably mounted to body 110 at connector 120 via threads 122, 21 in the manner previously described above. As CCL 20 is threadably secured to body 110, contact pin 220 is brought into engagement with the electrical contact assembly 23 disposed within CCL 20 such that contact pin 220 is electrically coupled to the electrical contact assembly of CCL 20 (note: only outer profile of contact assembly 200 is shown in FIG. 2 so as not to unduly complicate the figures). In at least some embodiments, when CCL 20 is secured to body 110 and contact pin 220 is engaged with the electrical contact assembly 23 within CCL 20, contact pin 220 is driven axially in toward body 110; however, because contact pin 220 may reciprocate, plunge, or translate axially within housing 210 and thus body 110, any axial forces experienced by contact pin 220 during engagement with contact assembly 23 in CCL 20 may be accommodated while still maintaining electrical contact between contact pin 220 and both the electrical contact assembly 23 within CCL 20 and the other components of electrical contact assembly 200 in body 110 (e.g., biasing member 230, plug 240, conductor 264, etc.).

Referring now to FIGS. 2, 4, and 6, during operations, an explosive charge (or charges) (not shown) within perforating gun body 30 is initiated with an electrical signal that is generated at the surface (i.e., at the surface of the subterranean well), routed downhole through the electrical contact assembly 23 within CCL 20, through electrical contact assembly 200, and into perforating gun body 30 via the connection between the conductor 264 of contact assembly 200 and conductor 33 of perforating gun body 30. Once the explosive charge (or charges) of perforating gun body 30 are initiated, the blast drives dart 192 axially toward upper end 110*a* of body 110 such that cutting surface 191 severs the conductor 33 of perforating gun body 30 (which is routed through the one or more grooves extending through dart 192). In addition, when dart 192 is driven axially toward upper end 110*a* following initiation of the explosive charges in perforating gun body 30, dart 192 becomes lodged in second axially passage and therefore seals passages 140, 150, 160 within body 110 from the wellbore conditions and the force of the perforating gun blast itself. As previously described, if dart 192 should fail to adequately seal passages 140, 150, 160 after the explosive charge within perforating gun body 30 is initiated, housing 210 itself operates as a bulkhead seal to protect the internal passages of CCL 20 as well as other components disposed uphole of CCL 20 during operations. Specifically, the sealing members 216 disposed about housing 210 and engaged within first axial passage 140 and the sealing members 244 disposed about plug 240 and engaged within bore 212 of housing 210 together prevent any fluid flow through first axial passage 140 past contact assembly 200 (either from third axial passage 160 or from the internal passages of CCL 20). Thus, if dart assembly 190 should fail to adequately seal off axial passages 140, 150, 160, electrical contact assembly 200 itself will prevent any further fluid flow past direction connection sub 100 into CCL 20.

Figure 8:
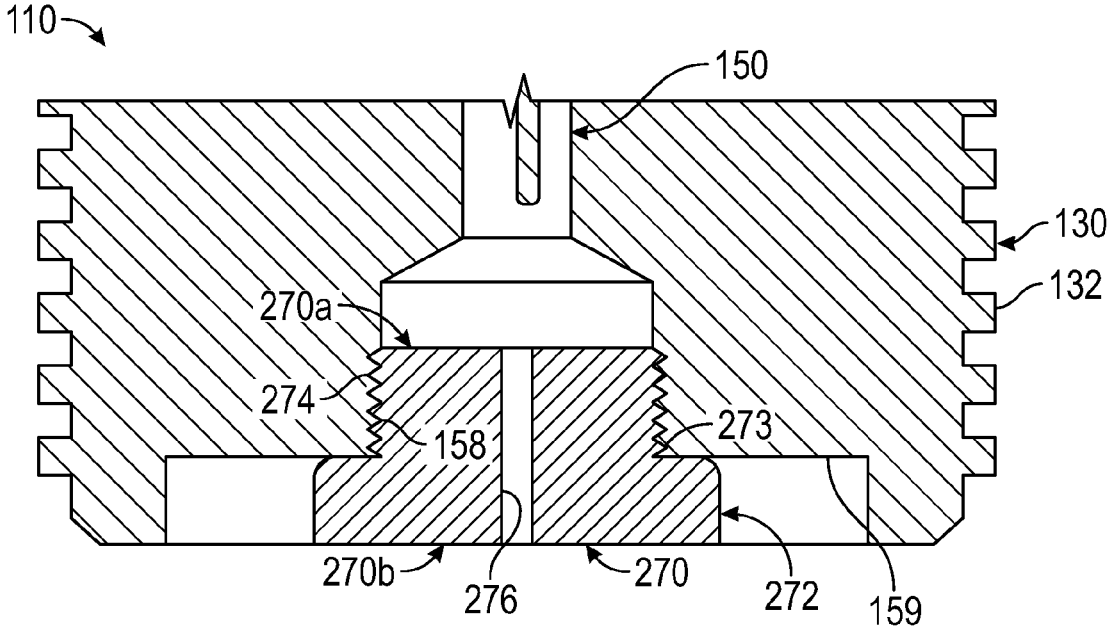
FIG. 8 is an enlarged side cross-sectional view of an end of the direct connect sub of FIG. 3 with a blast plug installed therein.

While embodiments disclosed herein have included a dart assembly 190 installed within second axial passage 150 within body 110, it should be appreciated that other or different mechanisms may be utilized in place of dart assembly 190 in other embodiments. For example, referring now to FIG. 8, in some embodiments, direct connect sub 100 may include a blast plug 270 in place of dart assembly 190. Blast plug 270 includes a first or upper end 270*a*, second or lower end 270*b* opposite upper end 270*a*, a flange 272 disposed at lower end 270*b* that defines a radially extending annular shoulder 273, and a set of external threads 274 disposed at or proximate to upper end 270*a*. In addition, blast plug 270 includes a central port or bore 276 extending axially between ends 270*a*, 270*b*. During operations, the blast plug 270 is secured within second axial passage 150 of body 110 by engaging external threads 274 on blast plug with internal threads 158 within second axial passage 150 until annular shoulder 273 engages or abuts with annular shoulder 159. Thereafter (or possibly prior to engaging blast plug 270 within second axial passage 150), the conductor wire 33 (not shown in FIG. 8) from perforating gun body 30 is inserted through bore 276 such that it may be coupled to conductor 264 of pigtail assembly 260 in the manner described above. During operations, blast plug 270 shields body 110 (particularly passages 140, 150, 160) and contact assembly 200 from the blast of perforating gun body 30. In some embodiments, blast plug 270 may comprise a steel alloy, such as, for example, 4140 alloy steel; however, other materials are possible. In addition, in some embodiments a surface finish may be applied to provide corrosion resistance and maximize component life; however, such surface finishes are not required.

Figure 9:
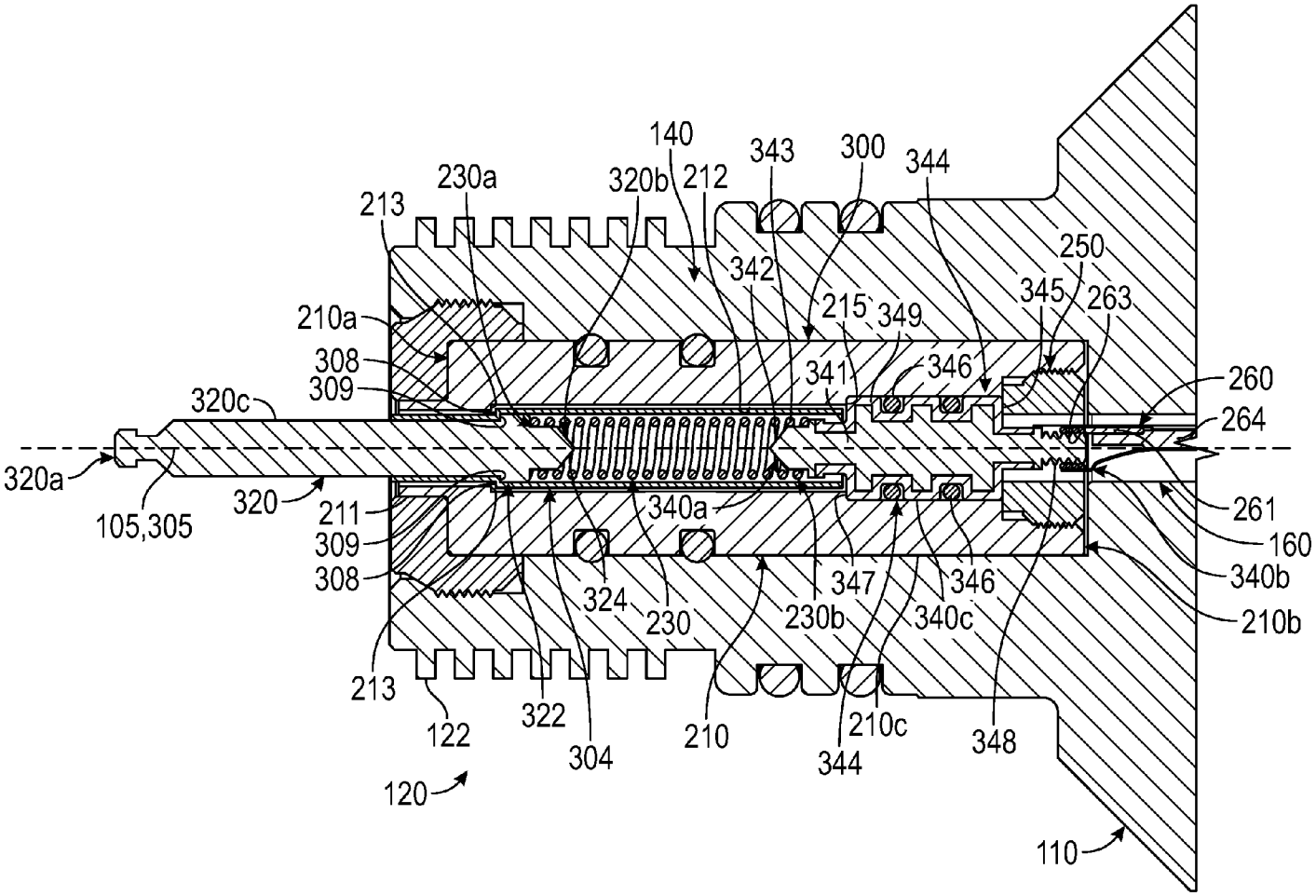
FIG. 9 is an enlarged side cross-sectional view of an alternative electrical contact assembly disposed within the direct connect sub of FIG. 3.

In addition, while embodiments of contact assembly 200 have included a plurality of insulating washers (e.g., washers 202, 206, 208, etc.) to electrically insulate the electrically conductive components within contact assembly (e.g. contact pin 220, biasing member 230, plug 240, etc.) from housing 210, in other embodiments, the electrical contact assembly may be alternatively designed or arranged such that fewer or no such insulating washers are required. For example, referring now to FIG. 9, another electrical contact assembly 300 for use within direct connect sub 100 is shown. Contact assembly 300 is generally similar to contact assembly 200, and thus, like parts are designated by like reference numerals and the discussion below will concentrate on the components and features of contact assembly 300 that are different from contact assembly 200.

Generally speaking, contact assembly 300 includes a central or longitudinal axis 305 that is aligned with axis 105 of body 110 during operations, housing 210, a contact pin 320, biasing member 230, a plug 340, retainer 250, an insulating tube 304, and pigtail assembly 260. Contact pin 320 includes a first or upper end 320*a*, a second or lower end 320*b* opposite upper end 320*a*, and a radially outermost surface 320*c* extending axially between ends 320*a*, 320*b*. Lower end 320*b* includes a conical tip 324. In addition radially outermost surface 320*c* is generally cylindrical in shape and includes a flange 322 disposed axially proximate to lower end 220*b*. Notably, radially outermost surface 320*c* does not include an annular recess, such as annular recess 221 formed on contact pin (see FIG. 6). In addition, contact pin 320 includes no insulating sleeve disposed about outermost surface 320*c*, such as insulating sleeve 226 disposed about surface 220*c* within recess 221 of contact pin 220 (see FIG. 5). Like contact pin 220 however, in some embodiments, contact pin 320 may comprise any conductive material, such as, for example mild steel, aluminum, brass, etc. Further, in some embodiments, a surface finish may be applied to contact pin 320 depending on the material used.

Plug 340 includes a first or upper end 340*a*, a second or lower end 340*b* opposite upper end 340*a*, and a radially outermost surface 340*c* extending between ends 340*a*, 340*b*. Upper end 340*a* includes a conical tip 342. Radially outermost surface 340*c* includes a first or upper annular shoulder 343 extending radially with respect to axis 305 and disposed axially between ends 340*a*, 340*b*. In addition, radially outermost surface 340*c* includes a second of lower annular shoulder 345 extending radially with respect to axis 305 and axially disposed between upper annular shoulder 343 and lower end 340*b*. Further, radially outer most surface 340*c* includes a third or mid annular shoulder 347 extending radially with respect to axis 305 and disposed axially between shoulders 343, 345. Also, radially outermost surface 340*c* includes a set of external threads 348 extending from lower end 340*b*. Radially outermost surface 340*c* also includes a pair of axially spaced annular seal grooves 344 each housing a corresponding sealing member 346 (e.g., an O-ring) which may be similar to seal members 126, 136, previously described. Notably, unlike plug 240, previously described, plug 340 comprises a two part material construction. Specifically, plug 340 comprises a first or internal portion 341 that includes conical tip 342, upper annual shoulder 343, and threads 348, and a second or external portion 349 that includes seal grooves 344, lower annular shoulder 345, and mid annular shoulder 347. Internal portion 341 comprises a conductive material such as, for example, a metal, and external portion 349 includes an electrically insulating material such as, for example a polymer. Specifically, in some embodiments, internal portion 341 of plug 340 comprises an aluminum material, such as, for example, 6061, 6262, etc., and external portion 349 of plug comprises PTFE, PEEK, etc. External portion 349 may be formed on and bonded internal portion 341 in any suitable manner. For example, in this embodiment, internal portion 341 is placed within a mold and then external portion 349 is injection molded about internal portion 341.

Insulating tube 304 is generally similar to insulating tube 204 previous described. However, insulating tube 304 is axially extended relative to insulating tube 204 such that insulating tube 304 extends within not only bore 212 but also within collar 211. As a result, insulating tube 304 includes an external radially extending annular shoulder 308 and an internal radially extending annular shoulder 309. Insulating tube 304 may comprise any suitable electrically insulating material, such as, for example, (PTFE) and/or PEEK.

During assembly of contact assembly 300, insulating sleeve 304 is axially inserted within bore 212 of housing 210 from lower end 210*b* until external annular shoulder 308 engages or abuts with annular shoulder 213 within housing 210. Thereafter contact pin 320 is axially inserted within bore 212 from lower end 210*b* until flange 322 engages or abuts with internal annular shoulder 309. Next, biasing member 230 is axially inserted within bore 212 of housing 210 from lower end 210*b* until upper end 230*a* engages or abuts with flange 322 on contact pin 320. Plug 340 may then be axially inserted within bore 212 from lower end 210*b* until upper annular shoulder 343 engages with lower end 230*b* of biasing member 230 and mid annular shoulder 347 engages or abuts with lower annular shoulder 215 in bore 212. Thereafter, retainer 250 may be threadably engaged within bore 212, and pigtail assembly 260 may be coupled to lower end of plug 340 in substantially the same manner as described above for contact assembly 200.

Therefore, due to the extended length of insulating tube 304 as compared to insulating tube 204 of contact assembly 200 (see FIG. 6), insulating tube 304 extends between not only bore 212 and contact pin 320 and biasing member 230, but also between collar 211 and contact pin 320 during operations. As a result, insulating washer 202 is eliminated from contact assembly 300. In addition, because plug 340 comprises a conductive internal portion 341 that is in contact with biasing member and pigtail assembly 260 and an electrically insulating external portion 349 that is in contact with bore 212 and retainer 250 (e.g., via annular shoulders 347, 345 and surface 310*c*), there is no longer a need for insulating washers 206, 208 from contact assembly 200.

Furthermore, it should also be appreciated that in some embodiments of electrical contact assembly 200 and/or electrical contact assembly 300, the material making up housing 210 may comprise an electrical insulator (e.g., a polymer) or housing 210 may be coated (e.g., outer surface 210*c* and bore 212) with an electrically insulating coating. In some of these embodiments, one or more of the washers 202, 206, 208, insulating tubes 204, 304, and insulating sleeve 226 are not included within contact assemblies 200, 300. Still further while embodiments of the direct connect sub 100 disclosed herein have engaged with both a CCL 20 and a perforating gun body 30, it should be appreciated that direct connect sub 100 may engage with a number of different components in other embodiments. For example, in some embodiments, direct connect sub 100 may engage with perforating gun body 30 and, for example, a well logging tool, weight bar, etc.

In the manner described, through use of a single bodied direct connect sub (e.g., sub 100) for coupling a CCL (e.g., CCL 20) to a perforating gun body (e.g., perforating gun body 30) in accordance with the embodiments disclosed herein, the number of components that are traditionally required to construct a perforating gun string is reduced. In addition, the length and number of electrical contacts required for electrically coupling a perforating gun body (e.g., perforating gun body 30) to the surface is also reduced. Further, through use of a contact assembly for electrically coupling a CCL to a perforating gun in accordance with the embodiments disclosed herein, an additional bulkhead seal may be formed by the electrical contact assembly itself, which thereby offers enhanced protection to components adjacent to the perforating gun during and after initiation of the explosive charges therein.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A perforating gun assembly, comprising:
- a perforating gun body;
- a casing collar locator (CCL);
- a direct connect sub coupled to the CCL and the perforating gun body, the direct connect sub comprising:
  - a single body including a central axis, a first end directly connected to the CCL, and a second end directly connected to the perforating gun body;
  - wherein the first end is engaged with the CCL; and
  - wherein the second end is engaged with the perforating gun body;
- an electrical contact assembly configured to electrically couple a component within the CCL to a conductor extending from the perforating gun body, wherein the contact assembly is disposed within the body of the direct connect sub and comprises:
  - a housing including an internal bore;
  - a contact pin is partially disposed within the bore;
  - a conductor is partially coupled to the contact pin, and
  - a plug disposed within the bore of the housing;
  - wherein the contact pin is configured to translate within the bore and extends into the CCL;
  - wherein the conductor of the electrical contact assembly is configured to be electrically connected to the conductor extending from the perforating gun body; and
  - wherein the plug is electrically coupled between the contact pin and the conductor of the electrical contact assembly.

2. The perforating gun assembly of claim 1, wherein the direct connect sub further comprises:
- a first set of threads disposed proximate the first end that are threadably engaged with corresponding threads of the CCL; and
- a second set of threads disposed proximate the second end that are threadably engaged with corresponding threads of the perforating gun body;
- wherein the first set of threads and the second set of threads are both external threads.

3. The perforating gun assembly of claim 1, wherein the body of the direct connect sub further comprises a port extending from an outer surface of the body to an internal passage extending within the body.

4. The perforating gun assembly of claim 1, wherein the housing is disposed within and sealingly engages a first axial passage within the body of the direct connect sub; and
- wherein the plug sealingly engages the bore of the housing.

5. The perforating gun assembly of claim 4, wherein the plug comprises:

an internal portion that is electrically conductive; and an external portion at least partially covering the internal portion, wherein the external portion is an electrical insulator.

6. The perforating gun assembly of claim 5, wherein the electrical contact assembly further comprises a biasing member disposed within the bore of the housing;

wherein the biasing member extends between the contact pin and the plug and electrically couples the contact pin to the plug.

7. The perforating gun assembly of claim 6, wherein the conductor of the electrical contact assembly extends into a second axial passage within the body;

wherein the second axial passage extends axially from the first axial passage;

wherein the body of the direct connect sub further comprises a port extending radially from an outer surface of the body to the second axial passage; and wherein the direct connect sub further comprises a port plug configured to be sealingly engaged within the port.

8. A direct connect sub for coupling a casing collar locator (CCL) to a perforating gun body, the direct connect sub comprising:

a single body including a central axis, a first end, a second end, and a port extending radially from an outer surface of the body to an internal passage extending within the body;

a first set of threads disposed proximate the first end that are configured to threadably engage with the CCL;

a second set of threads disposed proximate the second end that are configured to threadably engage with the perforating gun body.

9. The direct connect sub of claim 8, wherein the first set of threads and the second set of threads are both external threads.

10. The direct connect sub of claim 8, further comprising an electrical contact assembly disposed within the body of the direct connect sub, wherein the electrical contact assembly comprises:

a housing including an internal bore;

a contact pin is partially disposed within the bore; and a conductor electrically coupled to the contact pin;

wherein the contact pin is configured to translate within the bore and extend axially past the first end of the body.

11. The direct connect sub of claim 10, wherein the electrical contact assembly further comprises:

a plug disposed within the bore of the housing;

wherein the plug is electrically coupled between the contact pin and the conductor.

12. The direct connect sub of claim 11, wherein the housing is disposed within and sealingly engages a first axial passage within the body of the direct connect sub; and wherein the plug sealingly engages the bore of the housing.

13. The direct connect sub of claim 12, wherein the plug comprises:

an internal portion that is electrically conductive; and an external portion at least partially covering the internal portion, wherein the external portion is an electrical insulator.

14. The direct connect sub of claim 13, wherein the conductor of the electrical contact assembly extends into a second axial passage within the body;

wherein the second axial passage extends axially from the first axial passage;

wherein the port extends radially from the outer surface of the body to the second axial passage; and wherein the direct connect sub further comprises a port plug configured to be sealingly engaged within the port.

15. The direct connect sub of claim 12, wherein the electrical contact assembly further comprises a biasing member disposed within the bore of the housing;

wherein the biasing member extends between the contact pin and the plug and electrically couples the contact pin to the plug.

16. A direct connect sub for coupling a perforating gun body to a component, the direct connect sub comprising:

a single body including a first end and a second end;

a first set of threads disposed proximate the first end that are configured to threadably engage with the component;

a second set of threads disposed proximate the second end that are configured to threadably engage with the perforating gun body;

an electrical contact assembly disposed within the body of the direct connect sub, wherein the electrical contact assembly comprises:

a housing including an internal bore, wherein the housing is disposed within and sealingly engages a first axial passage within body;

a contact pin that is partially disposed within the bore and configured to translate within the bore;

a plug disposed within and sealingly engaging the bore of the housing;

a biasing member disposed within the bore of the housing, wherein the biasing member extends between the contact pin and the plug and electrically couples the contact pin to the plug; and a conductor electrically coupled to the plug, wherein the conductor extends into a second axial passage within the body that extends axially from the first axial passage; and a port extending from an outer surface of the housing to the second axial passage.

* * * * *